US005441003A

United States Patent [19]

Hashiride

[11] Patent Number: 5,441,003

[45] Date of Patent: Aug. 15, 1995

[54] SEWING MACHINE HAVING A REMOVABLE HEAD

[75] Inventor: Tadaaki Hashiride, Okazaki, Japan

[73] Assignee: Aisin Seiki Kabushiki Kaisha, Kariya, Japan

[21] Appl. No.: 302,960

[22] Filed: Sep. 12, 1994

Related U.S. Application Data

[63] Continuation of Ser. No. 40,860, Mar. 31, 1993, abandoned.

[30] Foreign Application Priority Data

Mar. 31, 1992 [JP] Japan ..... 4-076973

[51] Int. Cl.[6] ..... D05B 75/00; B65H 57/00

[52] U.S. Cl. ..... 112/259; 112/302; 112/168; 112/241

[58] Field of Search ..... 112/259, 168, 241, 302, 112/258, 260

[56] References Cited

U.S. PATENT DOCUMENTS

| | | | |
|---|---|---|---|
| 3,545,392 | 12/1970 | Fresard | 112/241 |
| 3,599,585 | 8/1971 | Myrick | 112/260 X |
| 4,590,875 | 5/1986 | Sanvito et al. . | |
| 4,624,201 | 11/1986 | Maggi | 112/260 X |
| 4,651,660 | 3/1987 | Oshima et al. | 112/241 X |
| 4,934,291 | 6/1990 | Yamamoto | 112/302 X |
| 5,105,750 | 4/1992 | Horie | 112/302 |
| 5,253,601 | 10/1993 | Sanvito | 112/259 X |

*Primary Examiner*—Clifford D. Crowder
*Assistant Examiner*—Paul C. Lewis
*Attorney, Agent, or Firm*—Oblon, Spivak, McClelland, Maier & Neustadt

[57] ABSTRACT

A sewing machine is comprised of a bed, an arm having a vertical portion set upright on the bed, and a horizontal portion horizontally extending from the upper end of the vertical portion, an arm shaft extended within and journaled on the arm, a sewing head detachably joined to the extremity of the arm, a needle bar incorporated into the sewing head, supported so as to be driven for vertical reciprocation on the sewing head by the arm shaft, and capable of being removed from the arm together with the sewing head, a motion converting means detachably connected with the needle bar to convert the rotation of the arm shaft into the reciprocation of the needle bar, a needle thread feed device disposed on the sewing head to feed a needle thread to a needle attached to the lower end of the needle bar, and a thread takeup device disposed on the arm and capable of operating in synchronism with the vertical reciprocation of the needle bar to draw up the slack needle thread and of releasing the needle thread.

7 Claims, 5 Drawing Sheets

SEWING MACHINE HAVING A REMOVABLE HEAD

This application is a continuation of application Ser. No. 08/040,860, filed on Mar. 31, 1993, now abandoned.

BACKGROUND OF THE INVENTION

1. Field of the Invention

The present invention relates to a sewing machine.

2. Description of the Prior Art

When threading the needle thread pulled out from a spool on a sewing machine, the needle thread is passed sequentially through a thread guard, a thread guide, a needle thread tension regulator, a thread takeup device and the eye of a needle. When changing the needle thread, the spool is replaced with another spool and the needle thread pulled out from another spool is threaded on the sewing machine, or the needle thread of the old spool is cut at a position near the spool, the free end of the needle thread of another spool and the trailing end of the needle thread threaded on the sewing machine are tied up and the needle thread extended through the eye of the needle is pulled to thread the needle thread of another spool on the sewing machine.

However, whichever threading methods may be used, the change of the needle thread takes time and the tension of the needle thread must be adjusted every time the needle thread is changed, which also takes time.

Incidentally, a sewing machine disclosed in U.S. Pat. No. 4,590,875 is provided with a sewing head provided with a needle bar, and capable of being removed from the arm and of being replaced with another sewing head provided with a needle bar according to desired stitching operation, such as lock stitching operation or zigzag stitching operation. However, since the spool pin, the needle thread tension regulator and the yarn guides and the like of this sewing machine are arranged on the arm, the needle thread needs to be threaded on the sewing machine when the sewing head is changed.

SUMMARY OF THE INVENTION

Accordingly, it is an object of the present invention to provide a sewing machine facilitating the threading of another needle thread thereon when changing the needle thread threaded thereon for another needle thread.

A sewing machine in a first aspect of the present invention comprises: a bed; an arm having a vertical portion set upright on the bed, and a horizontal portion horizontally extending from the upper end of the vertical portion; an arm shaft extended within and journaled on the arm; a sewing head detachably joined to the extremity of the arm; a needle bar incorporated into the sewing head, supported so as to be driven for vertical reciprocation on the sewing head by the arm shaft, and capable of being removed from the arm together with the sewing head; a motion converting means detachably connected with the needle bar to convert the rotation of the arm shaft into the reciprocation of the needle bar; a needle thread feed means disposed on the sewing head to feed a needle thread to a needle attached to the lower end of the needle bar; and a thread takeup means disposed on the arm, and capable of operating in synchronism with the vertical reciprocation of the needle bar to draw up the slack needle thread and of releasing the needle thread. Preferably, the thread takeup means comprises a thread takeup lever provided with a guide groove for guiding the needle thread, from which the needle thread can be released, and a cover for closing and opening the guide groove.

In this sewing machine, the needle thread pulled out from a spool is guided by the needle thread feed means disposed on the sewing head, and the thread takeup means disposed on the arm to the needle attached to the lower end of the needle bar, and the sewing head can be removed from the arm. Therefore, when changing the needle thread threaded on the sewing machine for another needle thread, the needle thread threaded on the needle thread feed means is removed from the thread takeup means, the sewing head is removed from the arm together with the needle thread, and another sewing head on which another needle thread is threaded is joined to the arm. Thus, the needle thread need not be threaded on the needle thread feed means when changing the needle thread.

A sewing machine in a second aspect of the present invention comprises: a bed; an arm having a vertical portion set upright on the bed, and a horizontal portion horizontally extending from the upper end of the vertical portion; an arm shaft extended within and journaled on the arm; a sewing head detachably joined to the extremity of the arm; a needle bar incorporated into the sewing head, supported so as to be driven for vertical reciprocation on the sewing head by the arm shaft, and capable of being removed from the arm together with the sewing head; a motion converting means detachably connected with the arm shaft to convert the rotation of the arm shaft into the reciprocation of the needle bar; a needle thread feed means disposed on the sewing head to feed a needle thread to a needle attached to the lower end of the needle bar; and a thread takeup means disposed on the sewing head, and capable of operating in synchronism with the vertical reciprocation of the needle bar to draw up the slack needle thread and of releasing the needle thread. In this sewing machine, the needle thread is threaded only on the sewing head.

In this sewing machine, both the needle thread feed means and the thread takeup means are disposed on the sewing head, and the needle thread is threaded only on the sewing head. Accordingly, when changing the needle thread, the needle thread can be simply removed from the arm together with the sewing head.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

A sewing machine in a first embodiment according to the present invention will be described hereinafter with reference to FIGS. 1 to 5.

Figure 1:
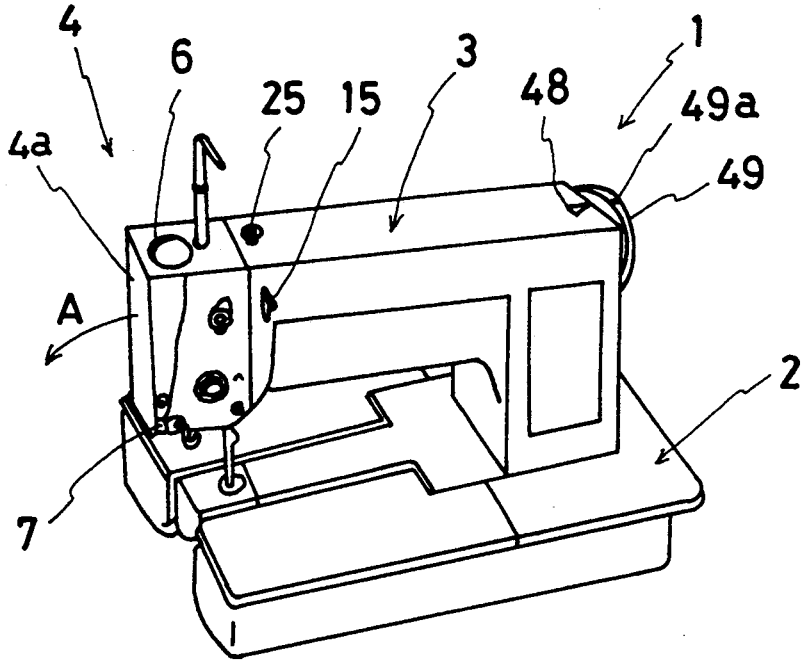
FIG. 1 is a perspective view of a sewing machine in a first embodiment according to the present invention.

Referring to FIG. 1, a sewing machine 1 in a first embodiment according to the present invention comprises a bed 2, an arm 3 having a vertical portion set upright on the bed, and a horizontal portion horizontally extending from the upper end of the vertical portion, and a sewing head 4 detachably joined to the free end, i.e., the left end as viewed in FIG. 1, of the arm 3. The sewing head 4 has an outer end wall swingable on a hinge 7 attached to the lower end thereof in the direction of the arrow A to open the sewing head 4. The upper wall of the sewing head 4 is provided with a circular through hole 6. The side surface 6*a* of the through hole 6 is finished in a rounded, smooth surface as shown in FIG. 3 to prevent damaging a needle thread 12 that slides along the side surface 6*a*.

Figure 2:
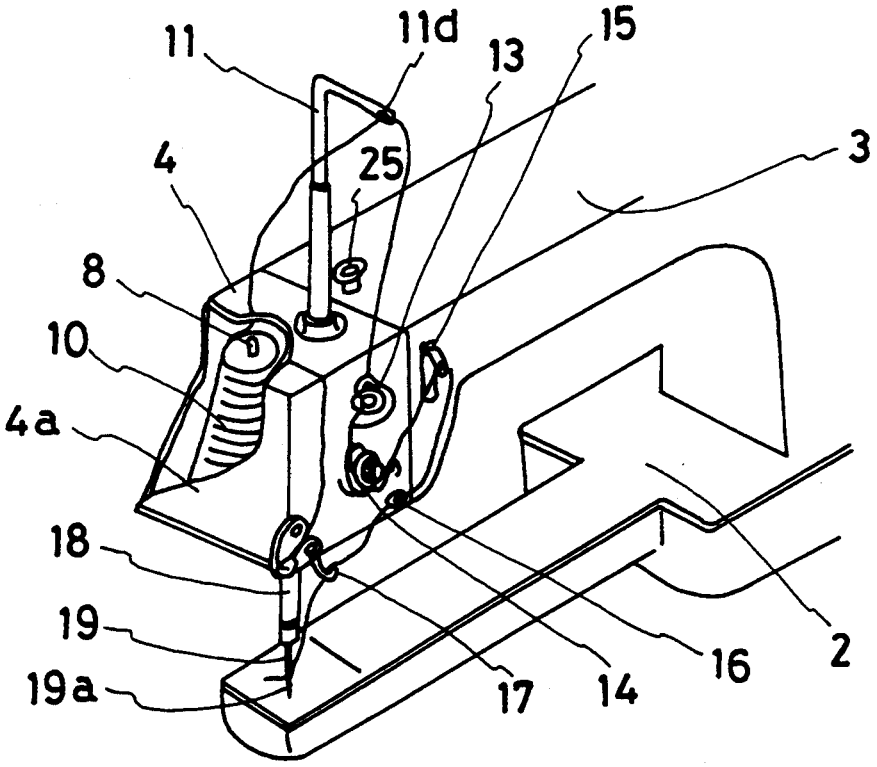
FIG. 2 is a fragmentary, partly cutaway perspective view of the sewing machine of FIG. 1.
Figure 3:
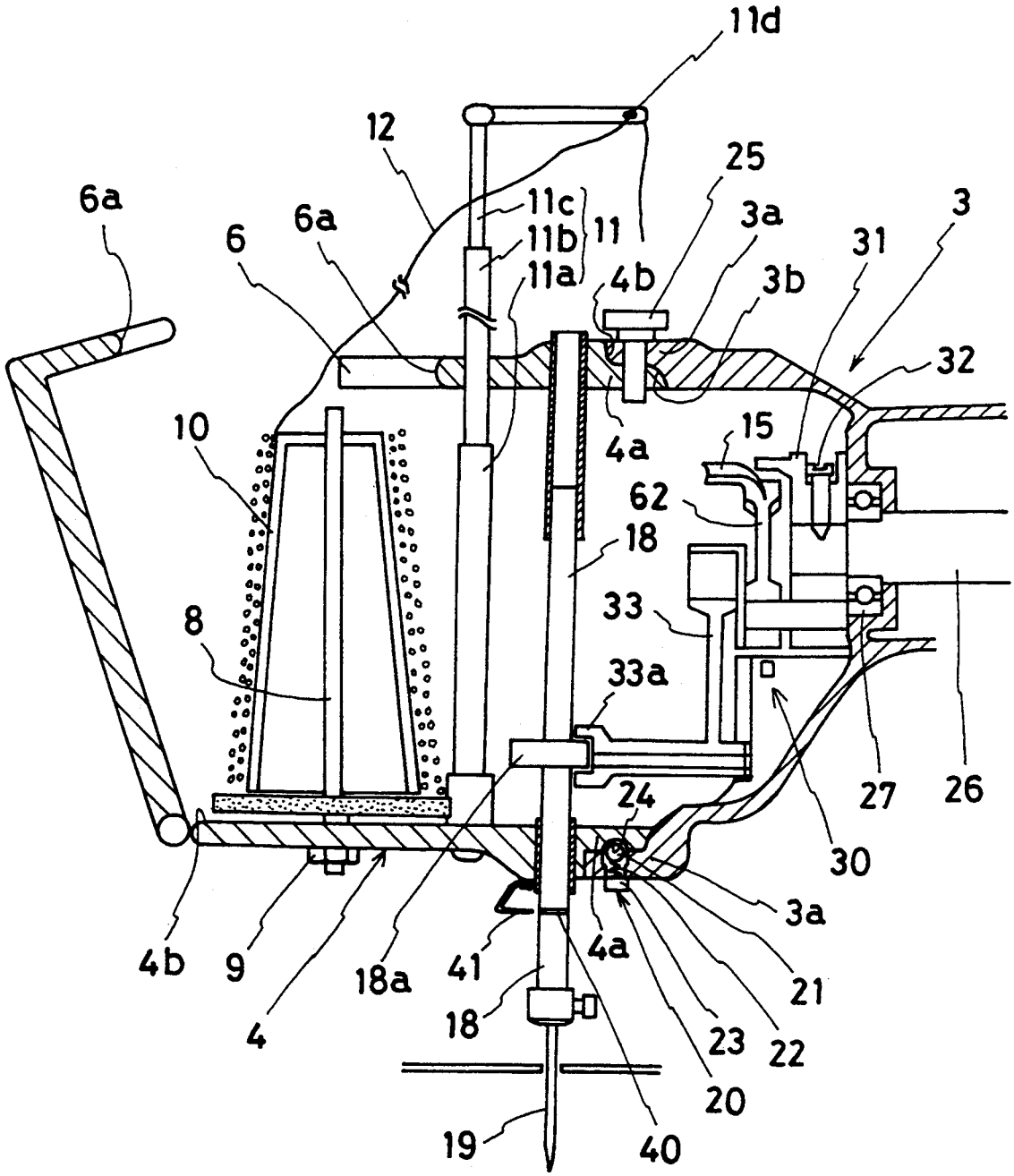
FIG. 3 is a sectional view of the sewing machine of FIG. 1.

Referring to FIGS. 2 and 3, a spool pin 8 is set upright on and fastened with a nut 9 to the bottom wall 4*b* of the sewing head 4, and a spool 10 is removably put on the spool pin 8. A telescopic yarn guide post 11 is held on the sewing head 4. The yarn guide post 11 consists of a fixed section 11*a* fastened to the bottom wall 4*b* in an upright position, an adjusting section 11*b* axially slidably inserted in the fixed section 11*a*, and a L-shaped guide section 11*c* axially slidably inserted in the adjusting section 11*b*. An eyelet 11*d* is formed in the extremity of the guide section 11*c*. The adjusting section 11*b* is moved axially relative to the fixed section 11*a*, and the guide section 11*c* is moved axially relative to the adjusting section 11*b* to adjust the vertical position of the eyelet 11*d*. Both a first thread tension regulator 13 and a second thread tension regulator 14 for regulating the tension of the needle thread 12 and both a first needle thread guide 16 and a second needle thread guide 17 for guiding the needle thread 12 are attached to the front wall of the sewing head 4. A thread takeup device 15, which will be described later, is disposed on the arm 3 at a position near the sewing head 4. The aforementioned yarn guide post, and first and second needle thread guides together comprise needle thread feed means. The needle thread 12 pulled out from the spool 10 through the eyelet 11*d* of the thread guide post 11 is guided via the first thread tension regulator 13, the second thread tension regulator 14, the thread takeup device 15, the first needle thread guide 16 and the second needle thread guide 17 in that order to the eye 19*a* of the needle 19. The sewing head 4 is provided with a presser assembly, not shown, for pressing down a work during sewing operation. The presser assembly may be of a manually operated type or of an electrically operated type operated by signals given thereto through the arm 3. When the presser assembly is of an electrically operated type, signals are transmitted by a signal transmission device which can be divided into a unit mounted on the arm 3 and a unit mounted on the sewing head 4.

Figure 4:
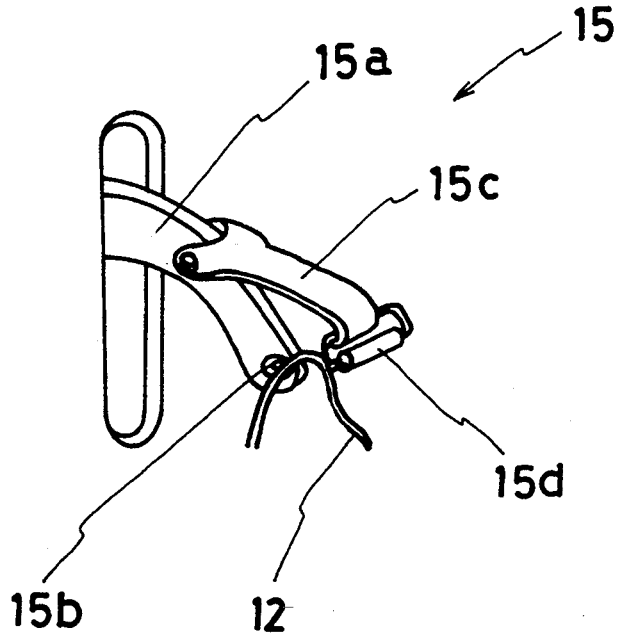
FIG. 4 is a thread takeup device included in the sewing machine of FIG. 1.

Referring to FIG. 4, the thread takeup device 15 consists of a thread takeup lever 15*a* provided with a guide groove 15*b*, and a cover member 15*c* capable of closing the guide groove 15*b*. The cover member 15*c* has one end pivotally joined to the thread takeup lever 15*a* and the other end provided with a roller 15*d* capable of being fitted in the guide groove 15*b*. When threading the thread takeup device 15 with the needle thread 12 or disengaging the needle thread 12 from the thread takeup device 15, the roller 15*d* is removed from the guide groove 15*b* to open the guide groove 15*b*. Thus, the needle thread 12 can be removed from the thread takeup device 15 without cutting off the needle thread 12.

A joint detachably joining together the arm 3 and the sewing head 4 will be described hereinafter with reference to FIG. 3. A female joining part 3*a* is formed on the extremity of the arm 3 facing the sewing head 4, and a male joining part 4*a* mating with the female joining part 3*a* is formed on one end of the sewing head 4. The female joining part 3*a* and the male joining part 4*a* have shoulders 3*b* and 4*b*, respectively. When joining the sewing head 4 to the arm 3, the respective end surfaces of the arm 3 and the sewing head 4 are put in contact with the shoulders 3*b* and 4*b*, respectively, to set the sewing head 4 in place on the arm 3.

A positioning device 20 is disposed on the lower end of the female joining part 3*a* of the arm 3. The positioning device 20 comprises a ball 21, a spring 22 having one end in contact with the ball 21 and biasing the ball 21 toward the inner surface of the female joining part 3*a*, and a fastening member 23 fastening the other end of the spring 22 to the female joining part 3*a* of the arm 3. The positioning device 20 determines the angular position of the sewing head 4 relative to the arm 3. A fastening pin 25 is inserted detachably in through holes formed in the respective upper parts of the female joining part 3*a* and the male joining part 4*a*.

When joining the sewing head 4 to the arm 3, the male joining part 4*a* of the sewing head 4 is fitted in the female joining part 3*a* of the arm 3 so that the ball 21 of the positioning device 20 is fitted in a recess 24 formed in the outer surface of the male joining part 4*a*. In fitting the male joining part 4*a* of the sewing head 4 in the female joining part 3*a* of the arm, the ball 21 is depressed by the outer surface of the male joining part 4*a* and drops into the recess 24 when the sewing head 4 is set at a correct angular position on the arm 3. After the sewing head 4 has been thus correctly positioned on the arm 3, the pin is inserted in the through holes to secure the sewing head 4 on the arm 3.

A motion converting mechanism 30 interlocking a needle bar 18 with an arm shaft 26 will be described hereinafter.

The motion converting mechanism 30 converts the rotation of the arm shaft 26 detachably connected with the needle bar 18 into the reciprocation of the needle bar 18. The arm shaft 26 is supported in a bearing 27 on the arm 3, and a thread takeup crank 31 is fastened to the extremity of the arm shaft 26 with a screw 32. A thread takeup rod 62 holding the thread takeup lever 15, and a needle bar crank 33 are mounted on the thread takeup crank 31. A connecting part 33*a* having U-shaped section is formed at the extremity of the needle bar crank 33. When the sewing head 4 is joined to the arm 3, the connecting part 33*a* engages a needle bar stud 18*a* fixed to the needle bar 18. When rotated, the arm shaft 26 drives the needle bar 18 for vertical reciprocation through the thread takeup crank 31, the thread takeup rod 62 and the needle bar crank 33.

An annular indexing groove 40 is formed in a portion of the needle bar 18 projecting from the lower wall of the sewing head 4, and an indexing means or member 41 is attached to the lower surface of the sewing head 4. When power supply to the sewing machine 1 is stopped, the sewing machine 1 stops with the needle bar 18 positioned at its top dead center. In this state, the indexing groove 40 of the needle bar 18 coincides with the indexing member 41. Accordingly, the needle bar stud 18*a* fixed to the needle bar 18 is able to engage the connecting part 33*a* of the needle bar crank 33 and the sewing head 4 can be easily joined to the arm 3, because the needle bar stud 18*a* fixed to the needle bar 18 coincides with the connecting part 33*a* of the needle bar crank 33 only if the needle bar 18 is positioned so that the indexing groove 40 coincides with the indexing member 41. When the needle bar 18 is positioned at its top dead center, a positioning mark 49*a* formed on a hand wheel 49 coincides with a positioning mark 48 formed on the arm 3. Therefore, even if the hand wheel 49 is turned after the sewing machine 1 has stopped, the arm shaft 26 can be set at an angular position corresponding to the top dead center of the needle bar 18 by aligning the positioning mark 49*a* of the hand wheel 49 with the positioning mark 48 of the arm 3.

Figure 5:
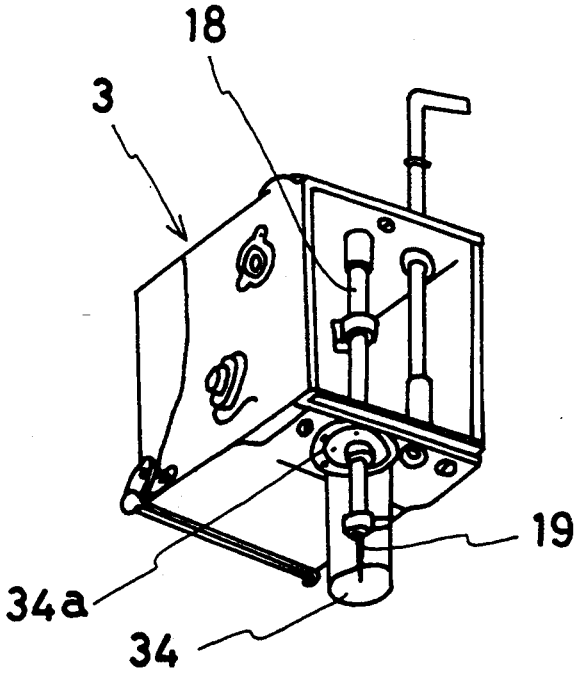
FIG. 5 is a perspective view of a sewing head included in the sewing machine of FIG. 1.

As shown in FIG. 5, the portion of the needle bar 18 projecting from the lower wall of the sewing head 4 can be covered with a needle cover 34 to protect the needle 19 attached to the lower end of the needle bar 18 particularly when the sewing head 4 is removed from the arm 3. When attaching the needle cover 34 to the sewing head 4, the upper edge 34*a* of the needle cover 34 is snapped in a holding groove, not shown, formed in the lower surface of the sewing head 4 round the needle bar 18. The needle cover 34 has, for example, a cylindrical shape as shown in FIG. 5. In this embodiment, the needle cover 34 is designed so that the indexing groove 40 of the needle bar 18 coincides with the indexing member 41 when the needle cover 34 is attached to the sewing head 4. Accordingly, when the sewing head 4 with the needle cover 34 attached thereto is joined to the arm 3, the needle bar stud 18*a* can be easily connected to the connecting part 33*a*.

A procedure of changing the needle thread 12 for another needle thread will be described hereinafter. During sewing operation, the needle thread 12 pulled out from the spool 10 put on the spool pin 8 travels through the eyelet 11*d*, the first thread tension regulator 13, the second thread tension regulator 14, the thread takeup lever 15, the first needle thread guide 16 and the second needle thread guide 17 and passes through the eye 19*a* of the needle 19. When changing the needle thread 12 for another needle thread, the cover 15*c* attached to the thread takeup lever 15 is opened to open the guide groove 15*b* of the thread takeup lever 15, the needle thread 12 is removed from the thread takeup lever 15, the fastening pin 25 is removed, and then the sewing head 4 is removed from the arm 3. Then, the male joining part of another sewing head, which is identical with the sewing head 4, threaded with another needle thread is fitted in the female joining part 3*a* of the arm 3, and then fastening the pin 25 is inserted in the through holes formed in the sewing head and the arm 3 to fasten another sewing head to the arm 3. Then, the needle thread of another sewing head is threaded on the thread takeup lever 15 to complete the procedure of changing the needle thread 12.

Thus, the needle thread 12 in use can be changed for another needle thread by replacing the sewing head 4 threaded with the needle thread 12 with another sewing head threaded with another needle thread. Accordingly, when another sewing head is joined to the arm 3, operations for threading another needle thread on another sewing head and for adjusting the tension regulators are unnecessary. Furthermore, since the needle thread 12 can be removed from the thread takeup lever 15, the sewing head 4 can be changed without cutting off the needle thread 12 even if the thread takeup lever 15 is disposed on the arm 3. Since the thread takeup lever 15 and the motion converting mechanism 30 interlocking the arm shaft 26 with the needle bar 18 are disposed on the arm 3, the sewing head 4 can be formed in a lightweight construction.

A sewing machine in a second embodiment according to the present invention will be described hereinafter with reference to FIGS. 6 to 8, in which parts like or corresponding to those of the first embodiment are denoted by the same reference characters.

Figure 6:
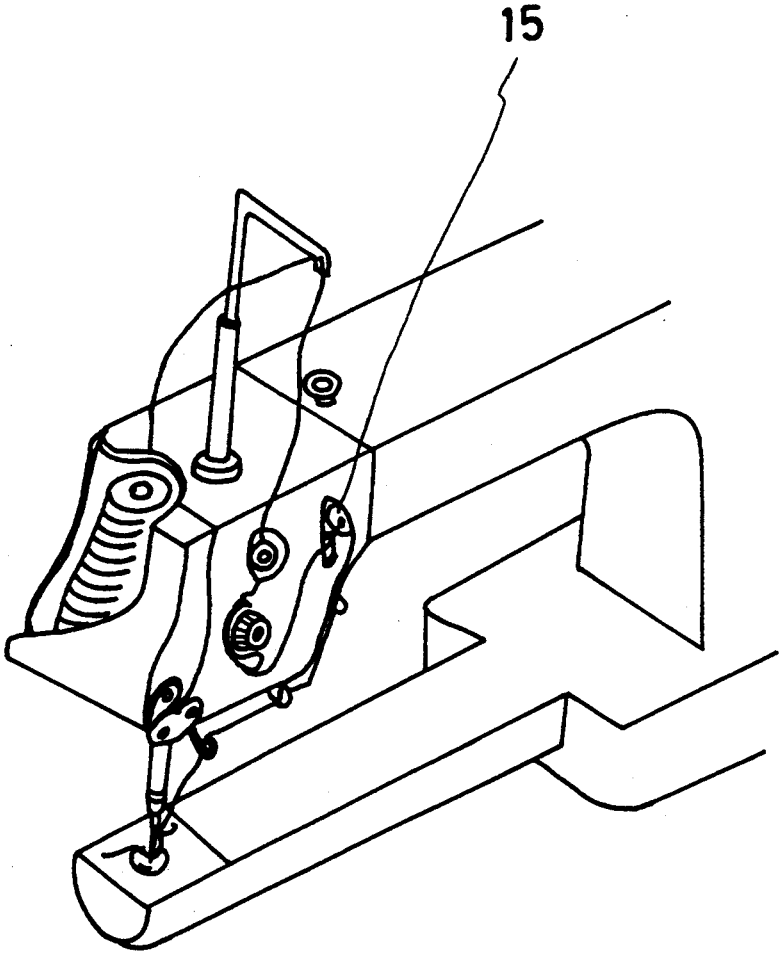
FIG. 6 is a fragmentary, partly cutaway perspective view of a sewing machine in a second embodiment according to the present invention.

A sewing machine 51 in the second embodiment is substantially the same in construction as the sewing machine 1 in the first embodiment, except that the sewing machine 51 has a sewing head 54 provided with a thread takeup lever 15 as shown in FIG. 6. The sewing head 54, similarly to the sewing head 4 of the first embodiment, is joined detachably to an arm 53.

Figure 7:
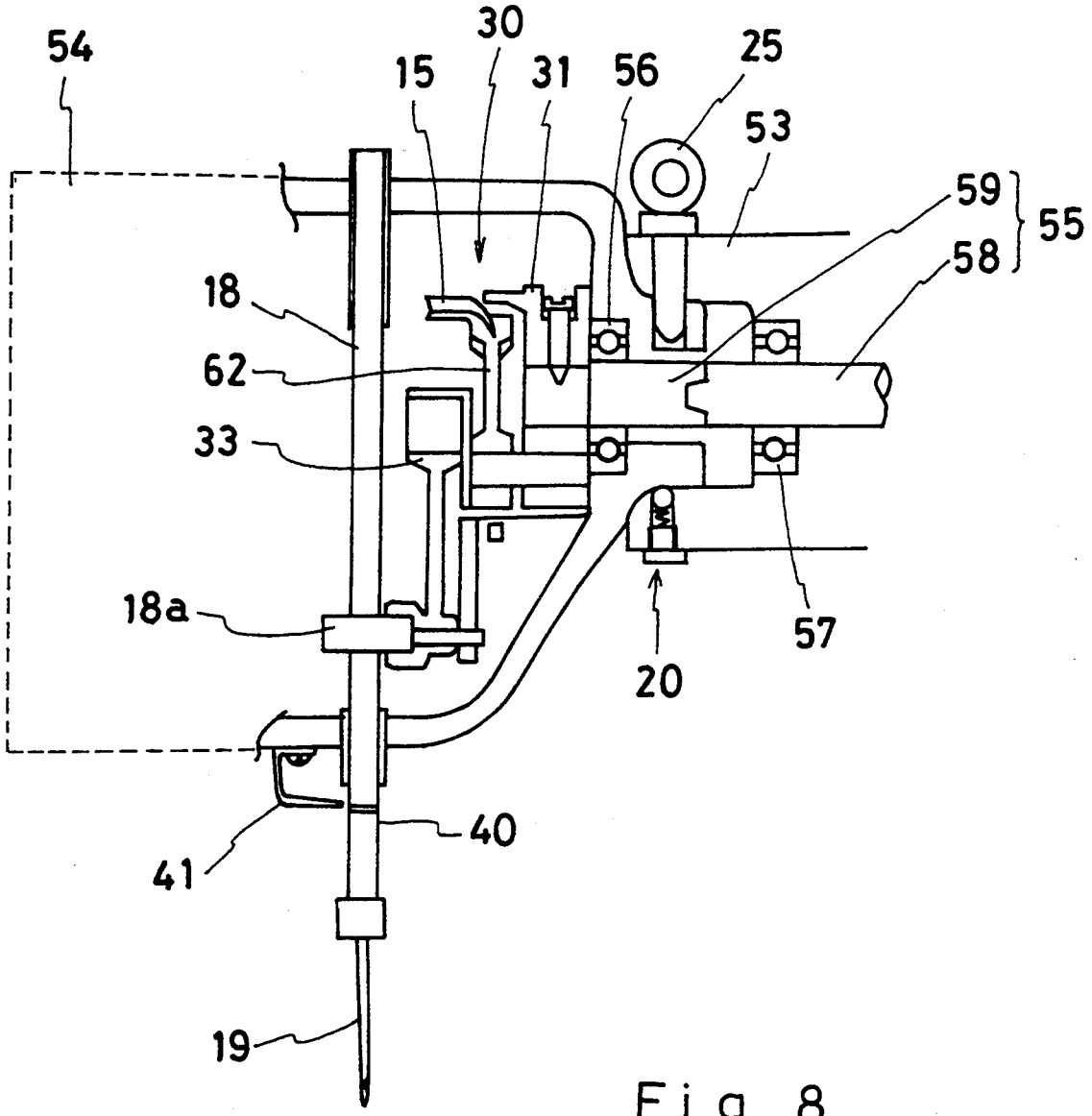
FIG. 7 is a sectional view of the sewing machine in the second embodiment.
Figure 8:
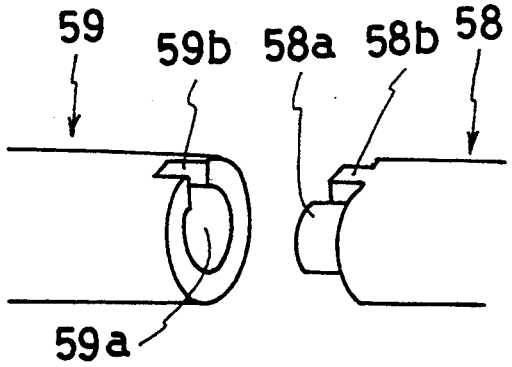
FIG. 8 is a fragmentary perspective view showing the construction of a joint formed in an arm shaft included in the sewing machine in the second embodiment.

As shown in FIG. 7, an arm shaft 55 has a first section 58 supported in a bearing 57 on the arm 53, and a second section 59 supported in a bearing 56 on the sewing head 54. As shown in FIG. 8, the first section 58 of the arm shaft 55 is provided with a reduced part 58*a* on its extremity, and a projection 58*b* formed on the circumference of the reduced part 58*a*. The second section 59 of the arm shaft 55 is provided with a central hole 59*a* in one end thereof, and a recess 59*b* formed in the same end thereof. When the first section 58 and the second section 59 of the arm shaft 55 are joined together, the reduced part 58*a* is fitted in the hole 59*a*, and the projection 58*b* engages the recess 59*b* to restrain the first section 58 and the second section 59 from turning relative to each other.

As shown in FIG. 7, a motion converting mechanism 30 comprising a thread takeup crank 31, a thread takeup rod 62 and the needle bar crank 33 is disposed on the sewing head 54.

In the sewing machine 51, the needle thread is threaded only on the sewing head 54. Therefore, the needle thread can be changed for another needle thread simply by replacing the sewing head 54 with another sewing head threaded with another needle thread.

The present invention is applicable also to an embroidery machine provided with a feed dog capable of being driven for XY movement.

As is apparent from the foregoing description, a sewing machine in accordance with the present invention enables the change of a needle thread in use for another needle thread by replacing a sewing head in use with another sewing head, eliminates operations for troublesome threading and thread tension adjustment, and curtails time required for changing the needle thread.

The indexing mark formed on the needle bar, and the indexing member attached to the sewing head ensure the correct vertical reciprocation of the needle bar after the sewing head provided with the needle bar has been joined to the arm.

The male joining part of the sewing head, the female joining part of the arm, the positioning device and the fastening pin enable the sewing head to be joined to and removed from the arm without using any too, such as a screw driver or the like.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A sewing machine comprising:

a bed;

an arm having a vertical portion set upright on the bed, and a horizontal portion horizontally extending from the upper end of the vertical portion;

an arm shaft extended within and journaled on the arm;

a sewing head detachably joined to the extremity of the arm;

a needle bar incorporated into the sewing head, supported so as to be driven for vertical reciprocation on the sewing head by the arm shaft, and capable of being removed from the arm together with the sewing head;

a motion converting means detachably connected with the needle bar to convert the rotation of the arm shaft into the reciprocation of the needle bar;

needle thread feed means and a thread spool support disposed on the sewing head to feed a needle thread to a needle attached to the lower end of the needle bar; and a thread takeup means disposed on the arm, and capable of operating in synchronism with the vertical reciprocation of the needle bar to draw up the slack needle thread and of releasing the needle thread.

2. A sewing machine according to claim 1, wherein the thread takeup means comprises a thread takeup lever provided with a guide groove for guiding the needle thread, from which the needle thread can be released, and a cover for closing and opening the guide groove.

3. A sewing machine according to claim 1, wherein the sewing head is provided with thread tension regulating means.

4. A sewing machine according to claim 1, wherein the sewing head is provided with needle thread guide means for providing a passage for the needle thread.

5. A sewing machine according to claim 1, wherein an indexing means is formed in combination with the sewing head and the needle bar to position the needle bar correctly at a vertical position appropriate for bringing the needle bar into engagement with the motion converting means when joining the sewing head to the arm.

6. A sewing machine according to claim 1, wherein the sewing head has a joining part on its one end, the arm has a joining part mating with the joining part of the sewing head on its extremity, the sewing head is positioned correctly on the arm by positioning means when the joining part of the sewing head and the joining part of the arm are engaged, and the sewing head is fastened to the arm when the joining part of the sewing head and the joining part of the arm are engaged with a fastening pin means.

7. The sewing machine according to claim 1, wherein said needle thread feed means includes at least one thread guide.

* * * * *